US012146503B2

(12) United States Patent
Huang

(10) Patent No.: US 12,146,503 B2
(45) Date of Patent: Nov. 19, 2024

(54) AIR CIRCULATION DEVICE

(71) Applicant: Really Useful Company Ltd., Apia (WS)

(72) Inventor: Yi-Li Huang, Apia (WS)

(73) Assignee: REALLY USEFUL COMPANY LTD., Apia (WS)

( * ) Notice: Subject to any disclaimer, the term of this patent is extended or adjusted under 35 U.S.C. 154(b) by 576 days.

(21) Appl. No.: 17/165,752

(22) Filed: Feb. 2, 2021

(65) Prior Publication Data

US 2022/0128066 A1 Apr. 28, 2022

(30) Foreign Application Priority Data

Oct. 23, 2020 (TW) ..... 109214010

(51) Int. Cl.
*F04D 29/44* (2006.01)
*F04D 25/06* (2006.01)
*F04D 29/28* (2006.01)

(52) U.S. Cl.
CPC ..... *F04D 29/441* (2013.01); *F04D 25/06* (2013.01); *F04D 29/281* (2013.01)

(58) Field of Classification Search
CPC ..... F04D 17/16; F04D 25/06; F04D 25/088; F04D 29/263; F04D 29/281; F04D 29/282; F04D 29/30; F04D 29/441; F04D 29/442; F04D 29/444; F04D 29/626; F05D 2230/50; F05D 2230/51; F21Y 2103/33; F21S 8/04; F21V 33/0096
See application file for complete search history.

(56) References Cited

U.S. PATENT DOCUMENTS 623,801 A * 4/1899 Melzer ..... F04D 25/088 314/131
1,699,201 A * 1/1929 Guth ..... F04D 29/281 392/364
4,342,073 A * 7/1982 Ranten ..... F04D 25/088 362/147
2014/0348658 A1* 11/2014 Cunnane ..... F04D 29/441 416/223 R
2017/0335861 A1* 11/2017 Lörcher ..... F04D 29/282
2020/0389065 A1* 12/2020 Allen ..... H02K 11/0094
2022/0042520 A1* 2/2022 Hsieh ..... F04D 29/36

* cited by examiner

*Primary Examiner* — Dominick L Plakkoottam
*Assistant Examiner* — Charles W Nichols
(74) *Attorney, Agent, or Firm* — HSML P.C.

(57) ABSTRACT

An air circulation device includes an impeller and a connecting unit. The impeller includes a plurality of blades that are disposed about a rotating axis and that are separably interconnected. The blades cooperatively define an inlet that is located at a central portion of a bottom end of the impeller, a plurality of outlets that are equiangularly disposed about the rotating axis and about the inlet, and a plurality of guide channels each of which is in fluid communication with the inlet and a respective one of the outlets. The connecting unit fixedly interconnects each adjacent pair of the blades.

17 Claims, 14 Drawing Sheets

AIR CIRCULATION DEVICE

CROSS-REFERENCE TO RELATED APPLICATION

This application claims priority to Taiwanese Utility Model Patent Application No. 109214010, filed on Oct. 23, 2020.

FIELD

The disclosure relates to an air circulation device, and more particularly to an air circulation device that is able to generate airflow.

BACKGROUND

A conventional centrifugal fan includes a housing, and an impeller disposed in the housing. The housing and the impeller are each configured as a one-piece component, so packing and transportation of the conventional centrifugal fan are relatively difficult.

SUMMARY

Therefore, an object of the disclosure is to provide an air circulation device that can alleviate at least one of the drawbacks of the prior art.

According to the disclosure, the air circulation device includes an impeller and a connecting unit. The impeller includes a plurality of blades that are disposed about a rotating axis and that are separably interconnected. The blades cooperatively define an inlet that is located at a central portion of a bottom end of the impeller, a plurality of outlets that are equiangularly disposed about the rotating axis and about the inlet, and a plurality of guide channels each of which is in fluid communication with the inlet and a respective one of the outlets. The connecting unit fixedly interconnects each adjacent pair of the blades.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
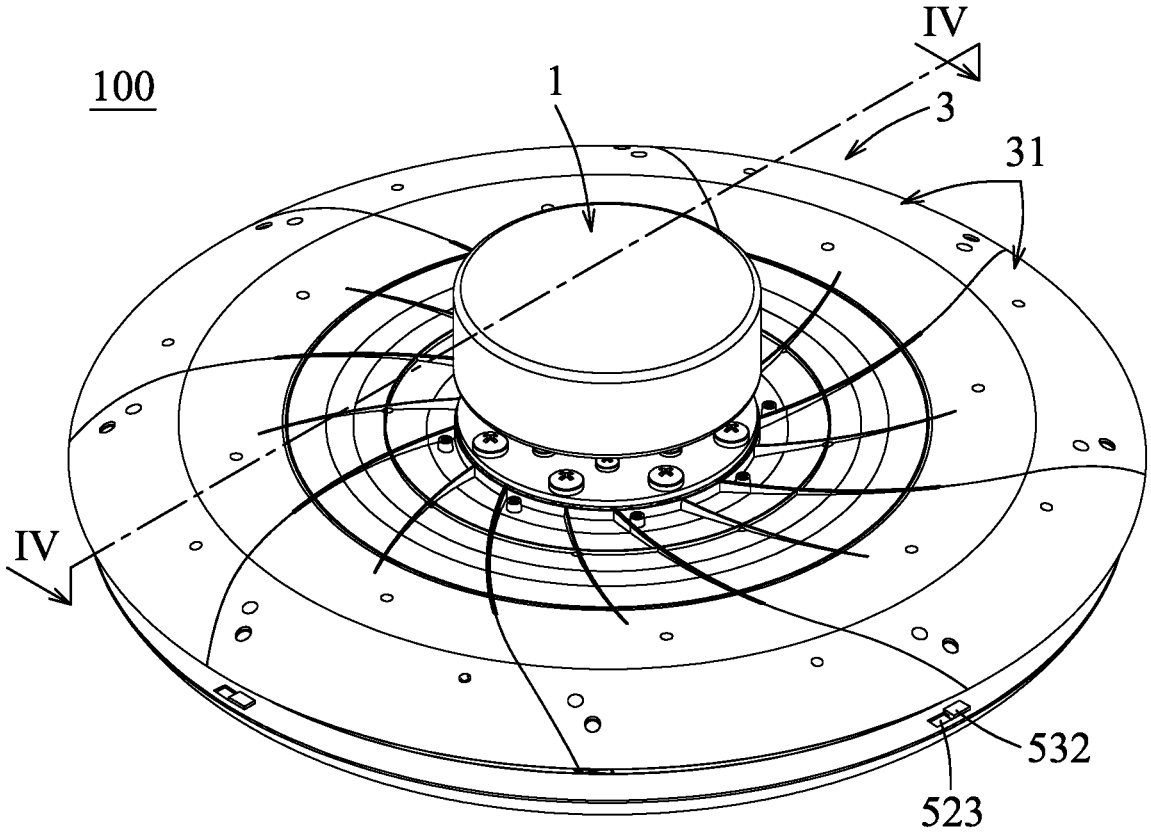
FIG. 1 is a perspective view illustrating a first embodiment of the air circulation device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
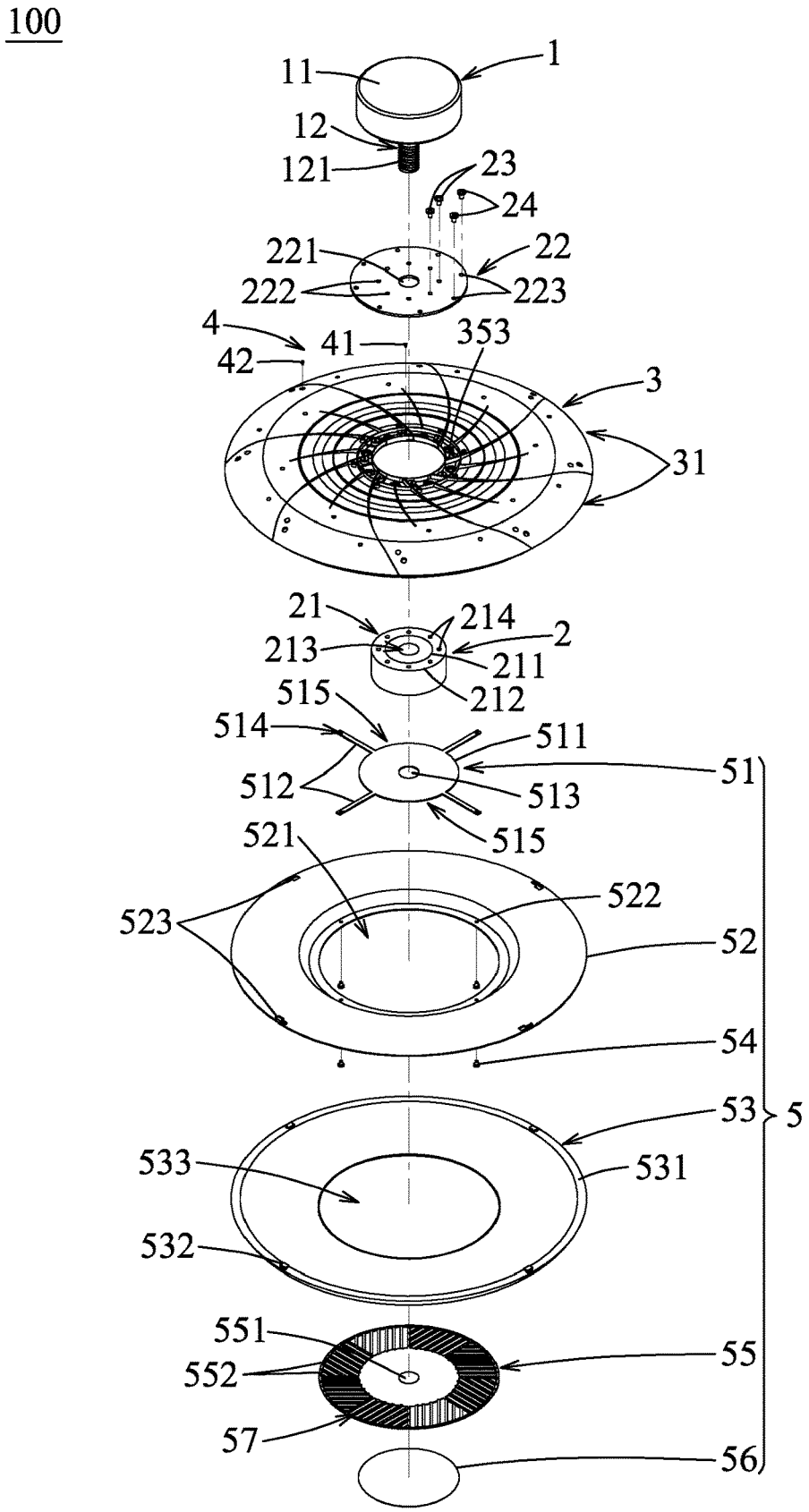
FIG. 2 is a top exploded perspective view illustrating the first embodiment.

Referring to FIGS. 1 and 2, the first embodiment of the air circulation device 100 according to the disclosure is adapted for being mounted on a ceiling 6 (see FIG. 13), and includes a support 1, a driving unit 2, an impeller 3, a connecting unit 4 and an add-on unit 5.

Figure 3:
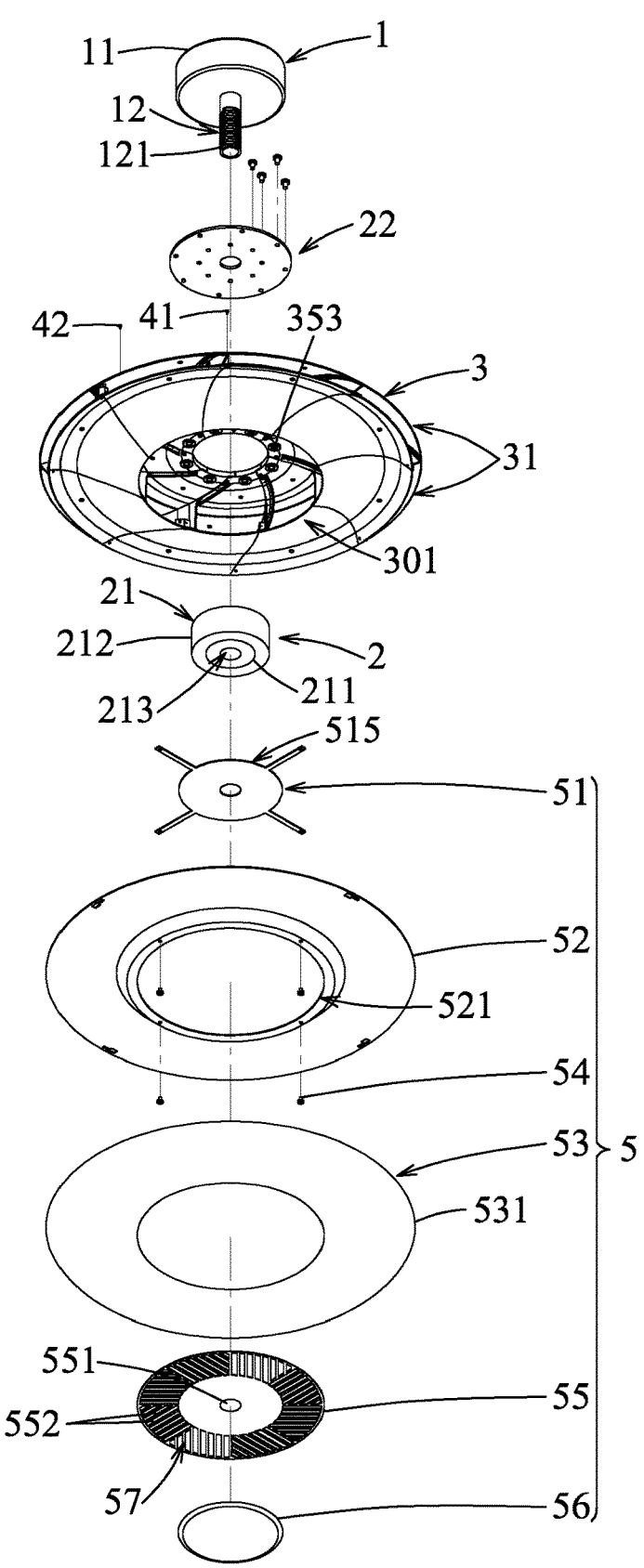
FIG. 3 is a bottom exploded perspective view illustrating the first embodiment.
Figure 4:
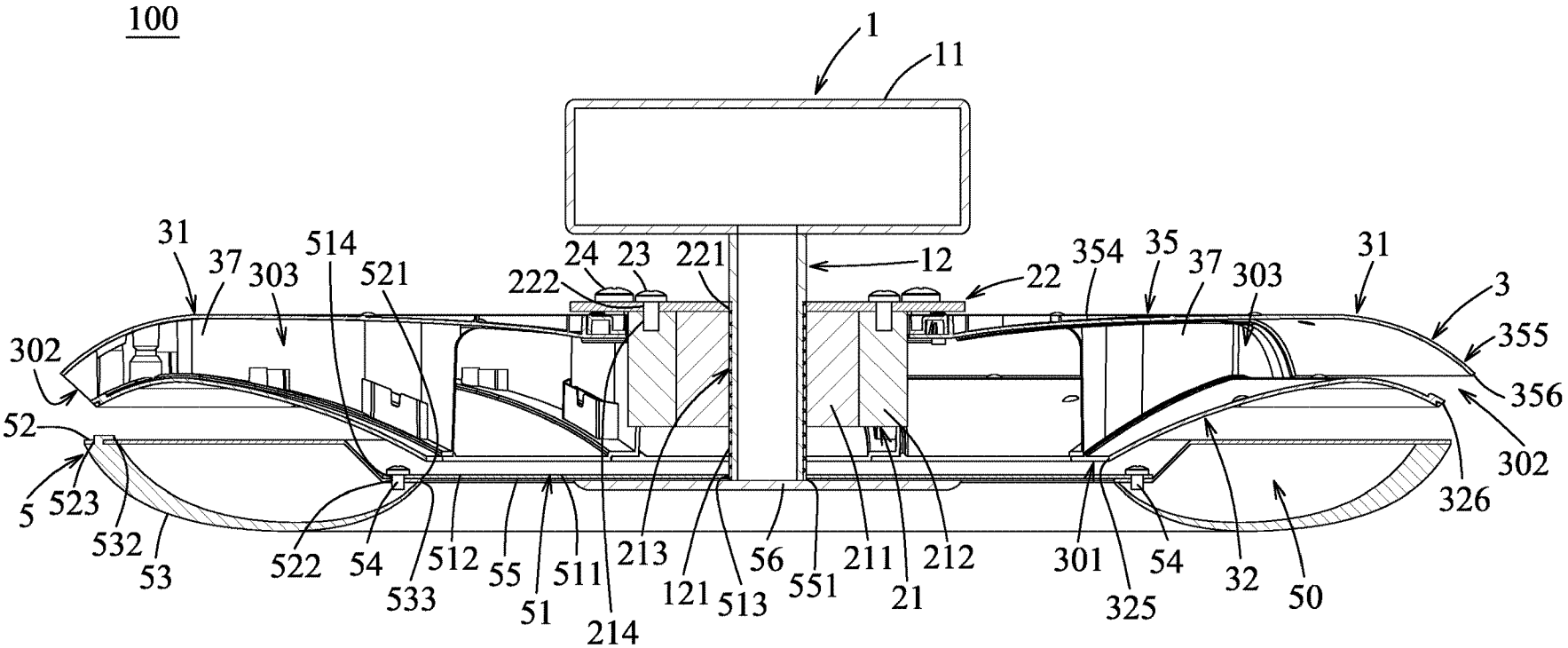
FIG. 4 is a sectional view illustrating the first embodiment.
Figure 5:
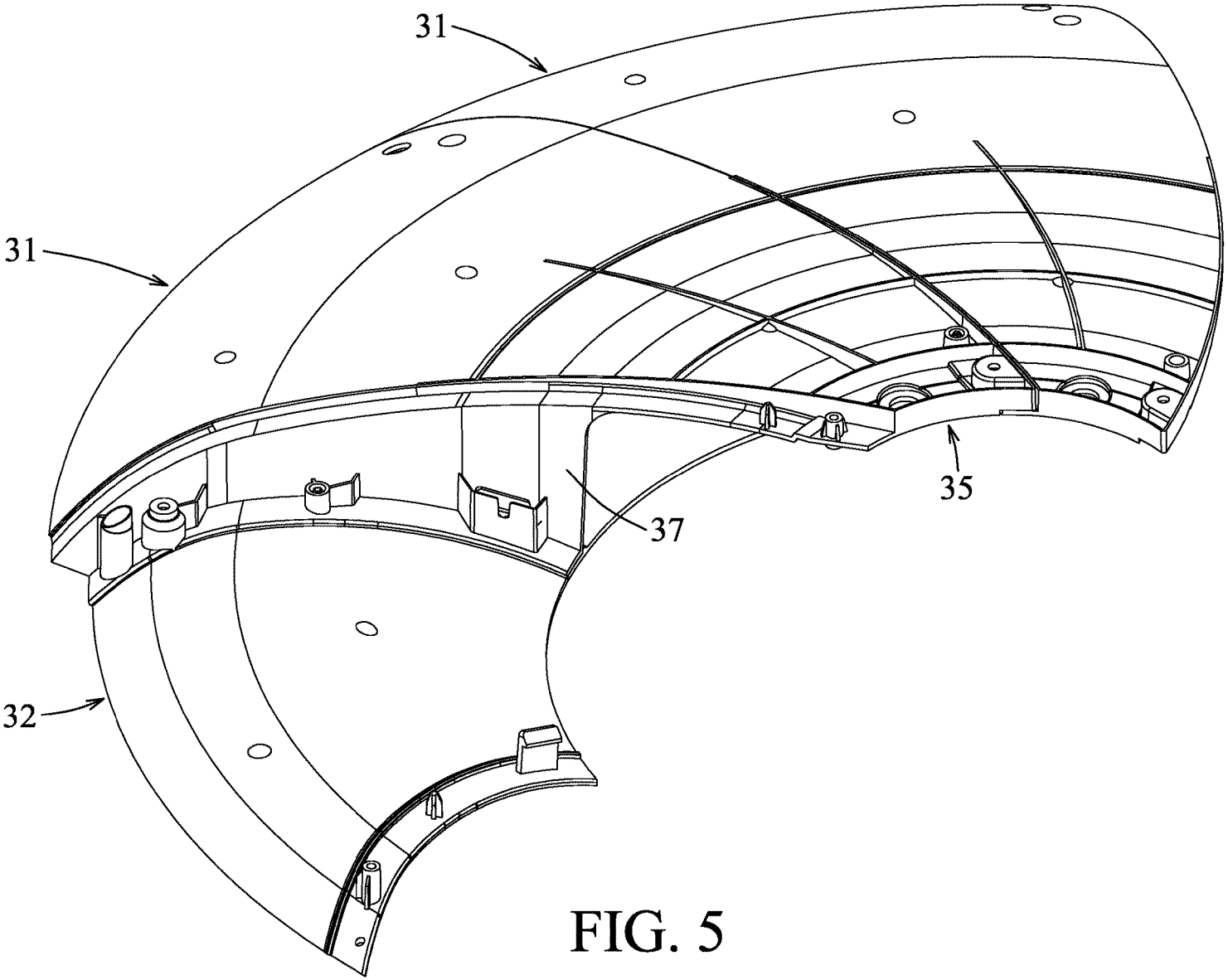
FIG. 5 is a top perspective view illustrating a blade of the first embodiment.

Referring further to FIGS. 3 and 4, the support 1 includes a case 11 and a fixed tube 12. The case 11 receives an electronic control module (not shown) therein, and has a top end mounted on the ceiling 6. The fixed tube 12 is disposed on a bottom end of the case 11, and is in spatial communication with an inner space of the case 11, so as to permit electrical cables (not shown) that are connected to the electronic control module to extend therethrough. The fixed tube 12 has an outer threaded section 121.

The driving unit 2 includes a motor 21, a transmission plate 22, a plurality of first screws 23 and a plurality of second screws 24. The motor 21 includes a stator 211 and a rotor 212. A central portion of the stator 211 is formed with a threaded hole 213 that permits the outer threaded section 121 of the fixed tube 12 to threadedly engage thereto. The rotor 212 surrounds the stator 211 and is able to be driven to rotate relative to the stator 211. A top surface of the rotor 212 is formed with a plurality of equiangularly spaced apart threaded holes 214. The transmission plate 22 is disposed above the motor 21, and is formed with a through hole 221 at a central portion thereof that permits the fixed tube 12 to extend therethrough, a plurality of equiangularly spaced apart first communication holes 222 that surround the through hole 221, and a plurality of equiangularly spaced apart second communication holes 223 that surround the first communication holes 222. Each of the first screws 23 extends through a respective one of the first communication holes 222 of the transmission plate 22 and engages threadedly a respective one of the threaded holes 214 of the rotor 212, such that the transmission plate 22 is co-rotatably connected to the rotor 212. Each of the second screws 24 extends through a respective one of the second communication holes 223 of the transmission plate 22.

The impeller 3 includes a plurality of blades 31 that are disposed about a rotating axis and that are separably interconnected (i.e., each blade 31 is adjacent to two blades 31). The blades 31 cooperatively define an inlet 301, a plurality of outlets 302 and a plurality of guide channels 303. The inlet 301 is located at a central portion of a bottom end of the impeller 3. The outlets 302 are equiangularly disposed about the rotating axis and about the inlet 301. Each of the guide channels 303 is in fluid communication with the inlet 301 and a respective one of the outlets 302.

Referring to FIGS. 4 to 7, in this embodiment, each of the blades 31 has a lower blade body 32, an upper blade body 35, and an arc-shaped blade body 37 that is connected between the lower blade body 32 and the upper blade body 35. For the sake of brevity, only one blade is described in detail in the following descriptions.

The lower blade body 32 is fan-shaped, and is configured to bend upwardly and then bend downwardly in a radially-outward direction such that a cross-section of the lower blade body 32 is arc-shaped (see FIG. 4). The lower blade body 32 has a lower main blade section 320, a first lower overlapping section 321 and a second lower overlapping section 322. The lower main blade section 320 has a first side edge 323 that is proximate to the arc-shaped blade body 37, and a second side edge 324 that is opposite to the first side edge 323. The first lower overlapping section 321 protrudes from a top surface of the lower main blade section 320 and extends from the first side edge 323 and away from the second side edge 324. The second lower overlapping section 322 extends from the second side edge 324 and away from the first side edge 323. The lower main blade section 320 cooperates with the first lower overlapping section 321 and the second lower overlapping section 322 to define a lower inner edge 325, and a lower outer edge 326 that is opposite to the lower inner edge 325 in a radial direction. The height of lower inner edge 325 is lower than that of the lower outer edge 326. The first lower overlapping section 321 of the lower blade body 32 of the blade 31 is disposed on a top surface of the second lower overlapping section 322 of an adjacent blade 31.

The lower blade body 32 further has a lower connecting barrel 327, a lower positioning barrel 328 and a projection 329. The lower connecting barrel 327, the lower positioning barrel 328 and the projection 329 are disposed on a top surface of the first lower overlapping section 321, and are sequentially disposed in a direction from the lower outer edge 326 toward the lower inner edge 325. The lower connecting barrel 327 is formed with a lower accommodating hole 330 extending therethrough in a top-bottom direction. The lower positioning barrel 328 is formed with a lower positioning hole 331 extending therethrough in the top-bottom direction. The projection 329 has a surrounding wall 332, a blocking wall 333 and two guiding walls 334. The surrounding wall 332 projects upwardly from the first lower overlapping section 321. The blocking wall 333 is inclined and is disposed inside the surrounding wall 332. Each of the guiding walls 334 is connected to the surrounding wall 332 and a bottom side of the blocking wall 333, and has a lower inclined surface 335 that faces downwardly.

The lower blade body 32 further has a lower threaded post 336, a lower positioning post 337, an engaging hook 338 and a stopping rib 339. The lower threaded post 336, the lower positioning post 337 and the engaging hook 338 are disposed on a top surface of the second lower overlapping section 322, and are sequentially disposed in the direction from the lower outer edge 326 toward the lower inner edge 325. The lower threaded post 336 is sleeved by the lower connecting barrel 327 of the lower blade body 32 of the other adjacent blade 31. The lower positioning post 337 is sleeved by the lower positioning barrel 328 of the lower blade body 32 of the other adjacent blade 31. The engaging hook 338 has a hook portion 340 near a top end thereof. The hook portion 340 has an upper inclined surface 341 that faces upwardly. The hook portion 340 engages the blocking wall 333 of the lower blade body 32 of the other adjacent blade 31. The stopping rib 339 protrudes from the top surface of the lower main blade section 320, is adjacent to the second side edge 324, and is connected to the top surface of the second lower overlapping section 322 for contacting and limiting the first lower overlapping section 321 of the lower blade body 32 of the other adjacent blade 31.

The upper blade body 35 is fan-shaped, and is configured to extend substantially horizontally and then bend downwardly in the radially outward direction. The upper blade body 35 has an upper main blade section 350, a first upper overlapping section 351 and a second upper overlapping section 352. The upper main blade section 350 is formed with a threaded hole 353 near a radially inner end thereof. The threaded hole 353 is threadedly engaged with a respective one of the second screws 24 that extends through the respective one of the second communication holes 223 of the transmission plate 22. The first upper overlapping section 351 and the second upper overlapping section 352 are respectively disposed at two opposite sides of the upper main blade section 350. The second upper overlapping section 352 is proximate to the arc-shaped blade body 37 and is located above the first lower overlapping section 321. The first upper overlapping section 351 is located at one side of the arc-shaped blade body 37 opposite to the second lower overlapping section 322. The first upper overlapping section 351 of the upper blade body 35 of the blade 31 is disposed on a top surface of the second upper overlapping section 352 of the adjacent blade 31. The upper main blade section 350 cooperates with the first upper overlapping section 351 and the second upper overlapping section 352 to define a horizontal part 354, and an outer bent guide part 355 that extends radially-outwardly from the horizontal part 354 and that bends downwardly. The outer bent guide part 355 has an upper outer edge 356. The upper main blade section 350 of the upper blade body 35 has a stopping surface 357 (see FIG. 6) that is connected to a top surface of the second upper overlapping section 352. The stopping surface 357 is for contacting and limiting the first upper overlapping section 351 of the upper blade body 35 of the other adjacent blade 31. The upper main blade section 350 is further formed with a communication hole 358 near the first upper overlapping section 351 and the upper outer edge 356. The communication hole 358 is located above and is registered with the lower accommodating hole 330 of the adjacent blade 31.

The upper blade body 35 further has an upper connecting barrel 359, an upper positioning barrel 360, an upper threaded post 361 and an upper positioning post 362. The upper connecting barrel 359 and the upper positioning barrel 360 are disposed on the first upper overlapping section 351, and are spaced apart from each other in the radial direction. The upper threaded post 361 and the upper positioning post 362 are disposed on a top surface of the second upper overlapping section 352, and are spaced apart from each other in the radial direction.

The upper connecting barrel 359 is formed with an upper accommodating hole 363 extending therethrough in the top-bottom direction. The upper positioning barrel 360 is formed with an upper positioning hole 364 extending therethrough in the top-bottom direction. The upper threaded post 361 is sleeved by the upper connecting barrel 359 of the upper blade body 35 of the other adjacent blade 31. The upper positioning post 362 is sleeved by the upper positioning barrel 360 of the upper blade body 35 of the other adjacent blade 31.

The arc-shaped blade body 37 is connected between a top end of the first lower overlapping section 321 and a bottom end of the second upper overlapping section 352. The arc-shaped blade body 37 is adjacent to a distal end of the first lower overlapping section 321 and a distal end of the second upper overlapping section 352. The arc-shaped blade body 37 is connected to the surrounding wall 332 of the projection 329, and is spaced apart from the blocking wall 333. The arc-shaped blade body 37 cooperates with the surrounding wall 332 to define a lower opening 342 (see FIG. 7), and an upper opening 343 that is located above the lower opening 342. The lower opening 342 permits the engaging hook 338 of the adjacent blade 31 to extend there through.

Figure 6:
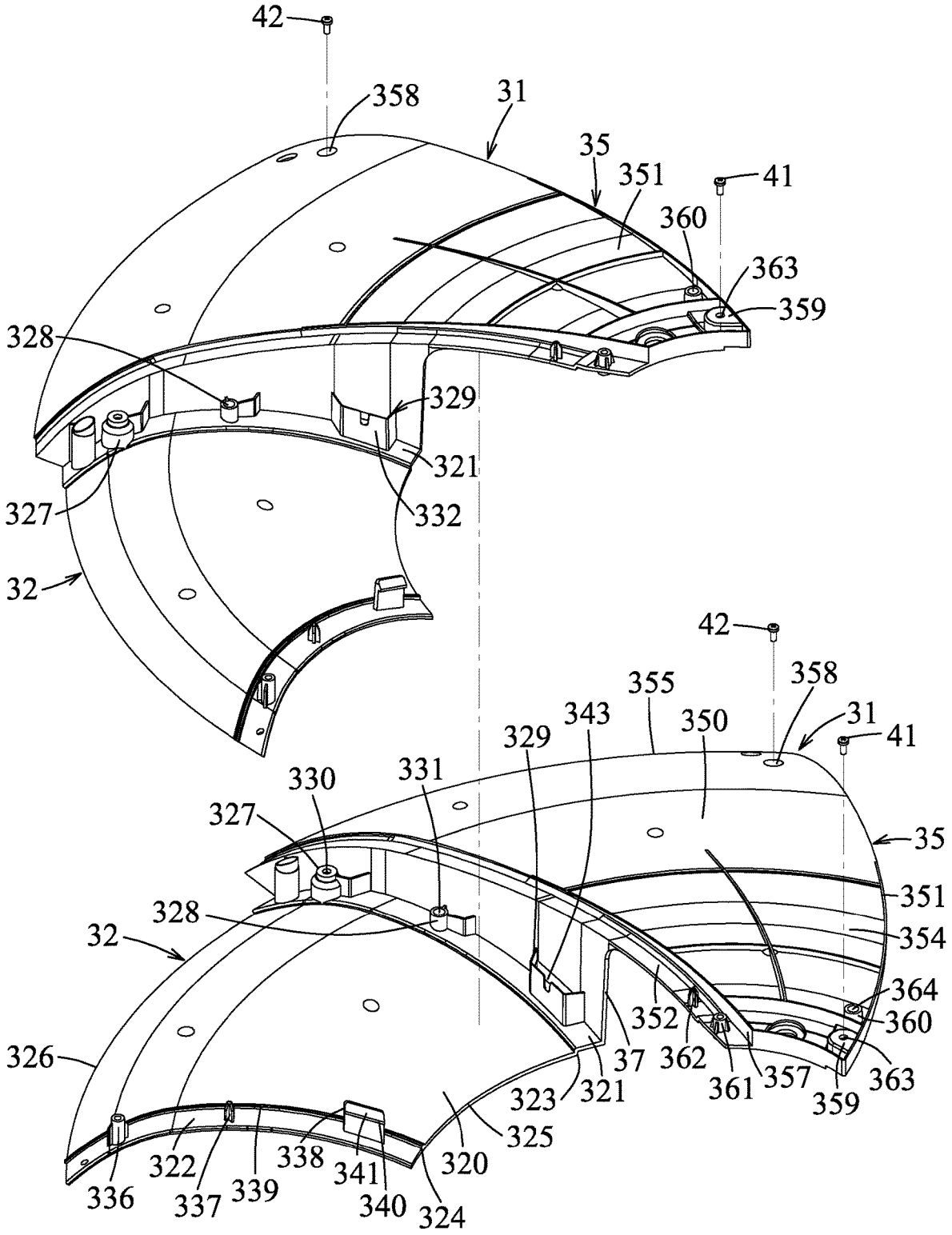
FIG. 6 is a top perspective view illustrating two of the blades.

Referring to FIGS. 2, 3 and 6, the connecting unit 4 includes a plurality of first connecting members 41 (see FIG. 6) and a plurality of second connecting members 42 (see FIG. 6). In this embodiment, the first and second connecting members 41, 42 are each exemplarily illustrated as a screw. Each of the first connecting members 41 extends through the upper accommodating hole 363 of the upper connecting barrel 359 of a respective one of the blades 31, and threadedly engages the upper threaded post 361 of an adjacent blade 31 that is sleeved by the upper connecting barrel 359 of the respective one of the blades 31. By such, the upper blade bodies 35 of each adjacent pair of the blades 31 are fixedly interconnected. Each of the second connecting members 42 extends through the communication hole 358 of a respective one of the blades 31 and the lower accommodating hole 330 of the lower connecting barrel 327 of the adjacent blade 31, and threadedly engages the lower threaded post 336 of another blade 31 which is adjacent to one side of the adjacent blade 31 opposite to the respective one of the blades 31 (the lower threaded post 336 of the another blade 31 is sleeved by the lower connecting barrel 327 of the adjacent blade 31). By such, the lower blade bodies 32 of each adjacent pair of the blades 31 and the upper blade body 35 of a blade 31 that is adjacent to the adjacent pair of the blades 31 are fixedly interconnected. By virtue of the first and second connecting members 41, 42, the blades 31 can be rapidly interconnected or disconnected from each other. In one embodiment, each of the first and second connecting members 41, 42 may be configured as an assembly of bolt and nut, but is not limited to such.

Referring to FIGS. 2 to 4, the add-on unit 5 of this embodiment is exemplarily illustrated as a lamp, and includes a connecting frame 51, a lamp plate 52, a lamp cover 53, a plurality of lamp screws 54, an intake cover 55 and a decoration panel 56. The connecting frame 51 has a connecting plate 511 and a plurality of connecting rods 512. The connecting plate 511 is circular, and is formed with a threaded hole 513 for the outer threaded section 121 of the fixed tube 12 to threadedly engage thereto. The connecting rods 512 extend radially-outwardly from an outer periphery of the connecting plate 511, and are equiangularly spaced apart from each other. Each of the connecting rods 512 is formed with a threaded hole 514 at a distal end thereof for being engaged with a respective one of the lamp screws 54. Any two adjacent ones of the connecting rods 512 cooperate with the outer periphery of the connecting plate 511 to define a breach 515 thereamong.

The lamp plate 52 is annular, and is formed with a communication hole 521 at a central portion thereof, a plurality of through holes 522 surrounding the communication hole 521 and adjacent to an inner periphery of the lamp plate 52, and a plurality of engaging holes 523 surrounding the communication hole 521 and adjacent to an outer periphery of the lamp plate 52. The lamp plate 52 abuts against bottom ends of the connecting rods 512, such that each of the lamp screws 54 extends through a respective one of the through holes 522 to engage the respective one of the threaded holes 514 of the connecting rods 512. Each of the engaging holes 523 is substantially L-shaped.

The lamp cover 53 has a cover body 531 and a plurality of engaging hooks 532. The cover body 531 covers a bottom end of the lamp plate 52, and cooperates with the lamp plate 52 to define a lamp space 50 for receiving a plurality of light-emitting components (not shown). The cover body 531 is formed with a communication hole 533 at a central portion thereof. The engaging hooks 532 are disposed on a top surface of the cover body 531, adjacent to an outer periphery of the cover body 531, and are equiangularly spaced apart from each other. Each of the engaging hooks 532 is in inverted L-shape, and engages a respective one of the engaging holes 523 of the lamp plate 52.

The intake cover 55 is formed with a threaded hole 551 and a plurality of intake holes 552. The threaded hole 551 is formed at a central portion of the intake cover 55 for the outer threaded section 121 of the fixed tube 12 to threadedly engage thereto. The intake holes 552 surround the threaded hole 551. The decoration panel 56 is attached to a bottom end of the intake cover 55 by adhesive to cover the threaded hole 551 of the intake cover 55. In one embodiment, the decoration panel 56 may be attached to the intake cover 55 through other manners.

Figure 7:
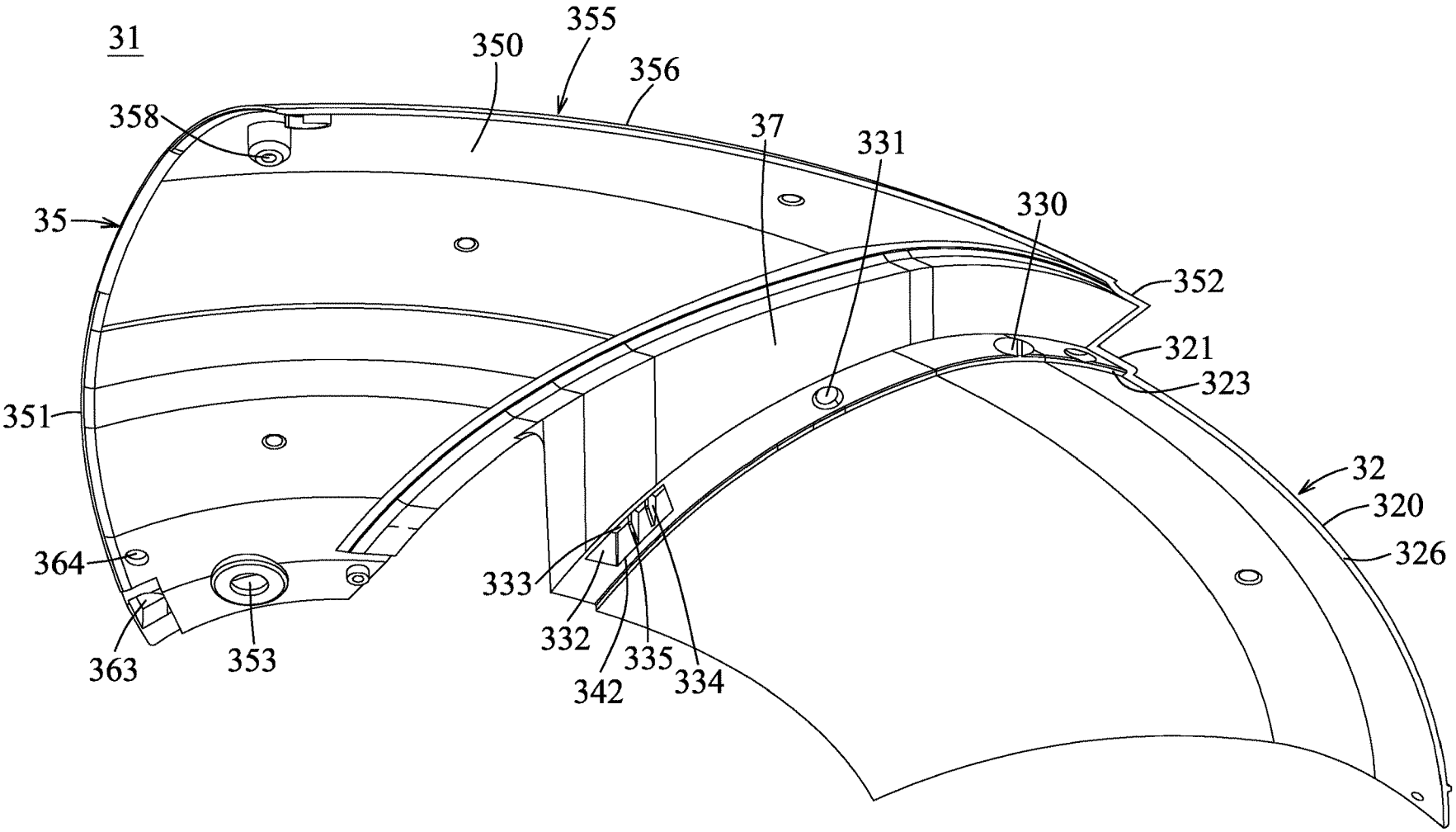
FIG. 7 is a bottom perspective view illustrating the blade.
Figure 8:
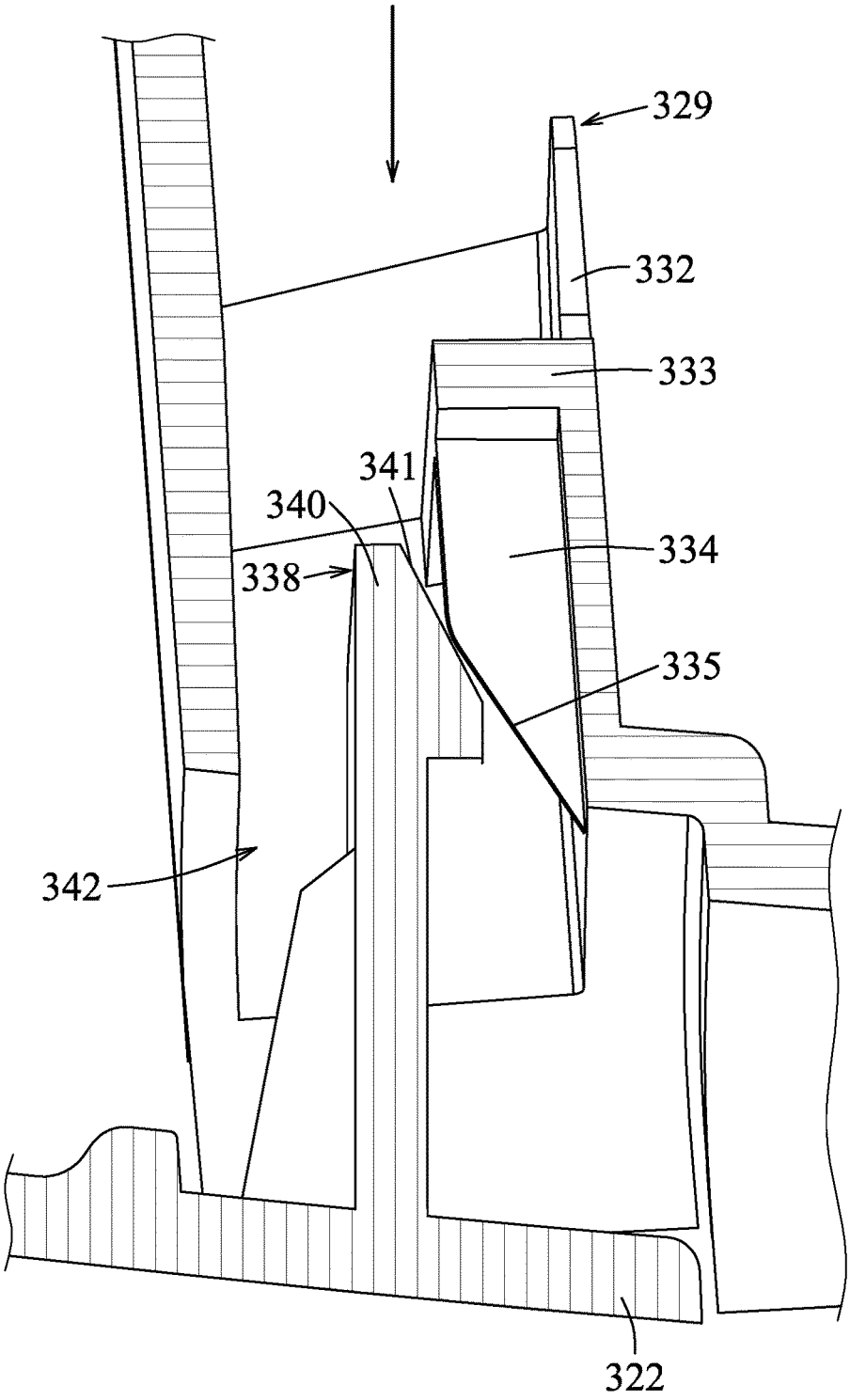
FIG. 8 is a fragmentary sectional view illustrating a projection and an engaging hook of the first embodiment, wherein a boldface arrowhead indicates movement of airflow.

Referring to FIGS. 4, 6 and 7, to assemble the air circulation device 100, the case 11 of the support 1 needs to be fixedly mounted to the ceiling 6 (see FIG. 13) first, and then the blades 31 of impeller 3 are to be assembled. In the assembly of the blades 31, the first lower overlapping section 321 and the first upper overlapping section 351 of one of the blades 31 are respectively disposed over the second lower overlapping section 322 and the second upper overlapping section 352 of another blade 31 first, such that the lower accommodating hole 330 of the lower connecting barrel 327, the lower positioning hole 331 of the lower positioning barrel 328, the lower opening 342 of the projection 329, the upper accommodating hole 363 of the upper connecting barrel 359 and the upper positioning hole 364 of the upper positioning barrel 360 of the one of the blades 31 are respectively aligned with the lower threaded post 336, the lower positioning post 337, the engaging hook 338, the upper threaded post 361 and the upper positioning post 362 of the another blade 31.

Then, as shown in FIGS. 6, 8, 9 and 10, the two blades 31 are moved toward each other, such that the engaging hook 338 of the another blade 31 extends into the lower opening 342 of the projection 329 of the one of the blades 31. During the relative movement between the two blades 31, the lower inclined surfaces 335 of the guiding walls 334 are in slidable contact with the upper inclined surface 341 of the engaging hook 338 to push the engaging hook 338 to deform relative to the second lower overlapping section 322 of the another blade 31. After the hook portion 340 of the engaging hook 338 moves past the blocking wall 333, the engaging hook 338 restores its form and engages the blocking wall 333 such that the first lower overlapping section 321 and the first upper overlapping section 351 of one of the blades 31 respectively abuts against the top surfaces of the second lower overlapping section 322 and the second upper overlapping section 352 of another blade 31, and that the two blades 31 are prevented from moving relative to each other in the top-bottom direction.

On the other hand, the lower threaded post 336, the lower positioning post 337, the upper threaded post 361 and the upper positioning post 362 of the another blade 31 respectively engage the lower accommodating hole 330 of the lower connecting barrel 327, the lower positioning hole 331 of the lower positioning barrel 328, the upper accommodating hole 363 of the upper connecting barrel 359 and the upper positioning hole 364 of the upper positioning barrel 360 of the one of the blades 31, the stopping rib 339 of the another blade 31 contacts and limits the first lower overlapping section 321 of the lower blade body 32 of the one of the blades 31, and the stopping surface 357 of the another blade 31 contacts and limits the first upper overlapping section 351 of the upper blade body 35 of the one of the blades 31, such that the two blades 31 are prevented from moving relative to each other in a transverse direction. The other blades 31 can be sequentially assembled to the two blades in a manner similar to the above so as to complete the assembly of the impeller 3.

Figure 11:
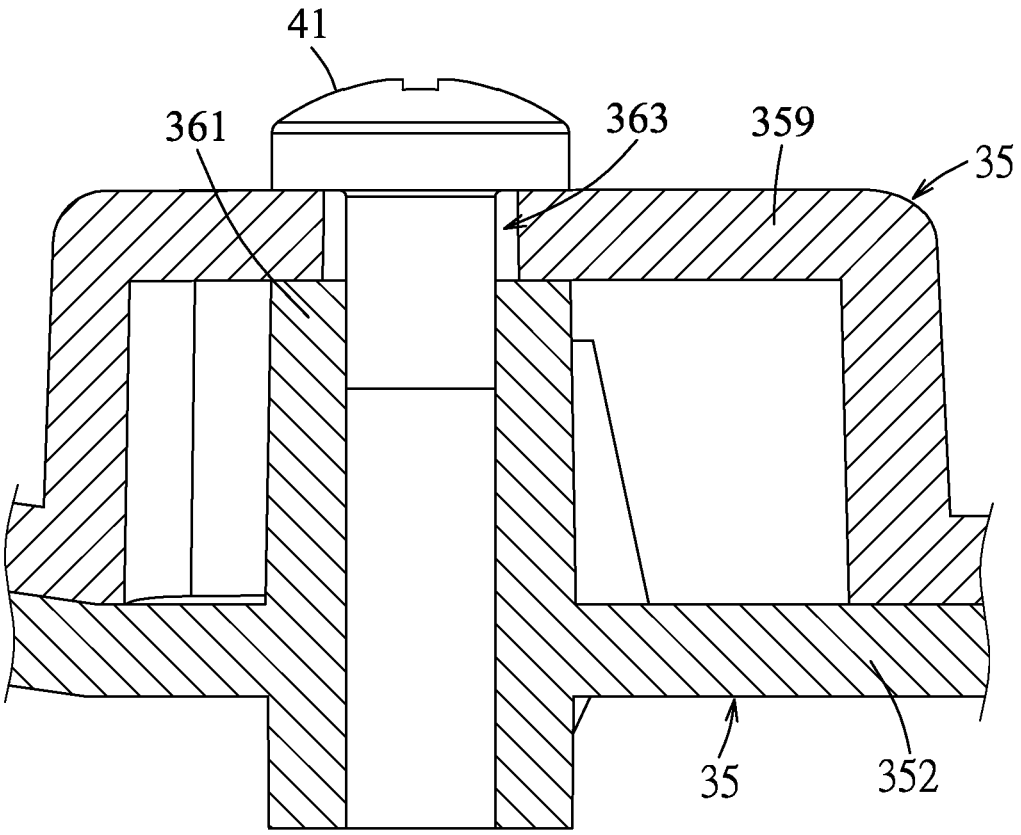
FIG. 11 is a fragmentary sectional view illustrating a first connecting member of the first embodiment fixedly interconnecting two of the blades.
Figure 12:
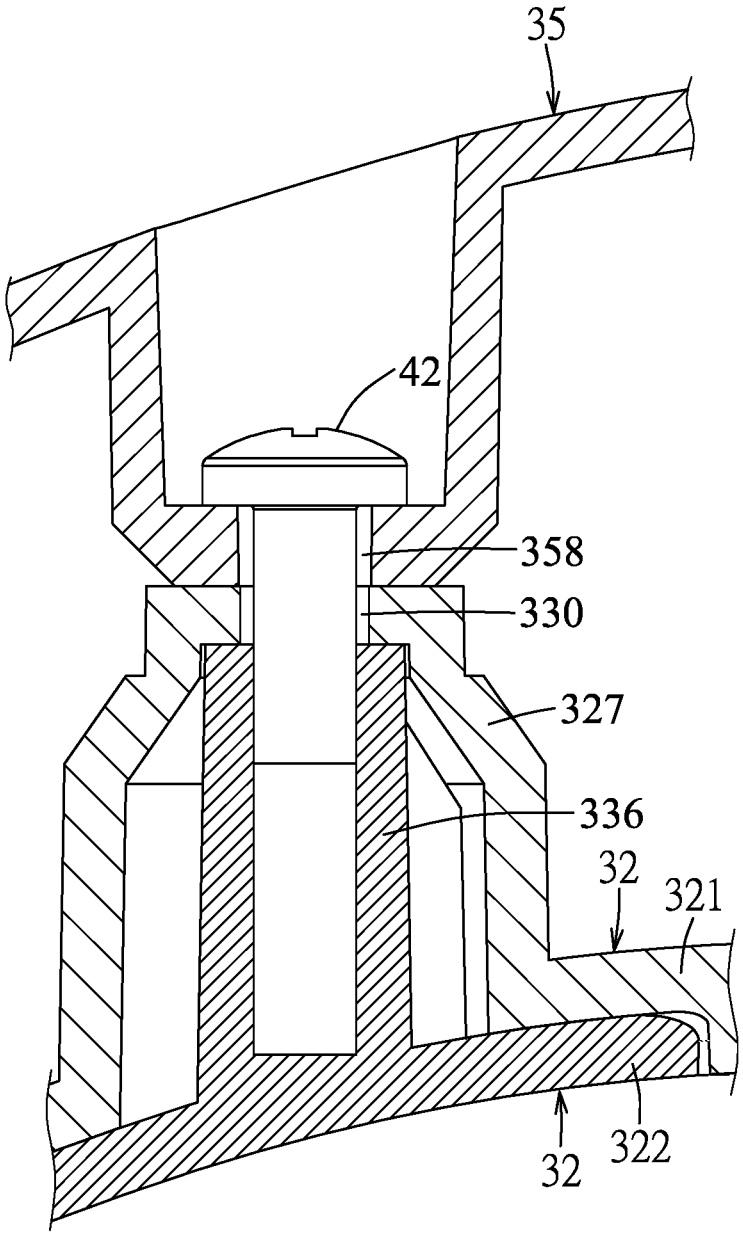
FIG. 12 is a second connecting member of the first embodiment fixedly interconnecting three of the blades.
Figure 13:
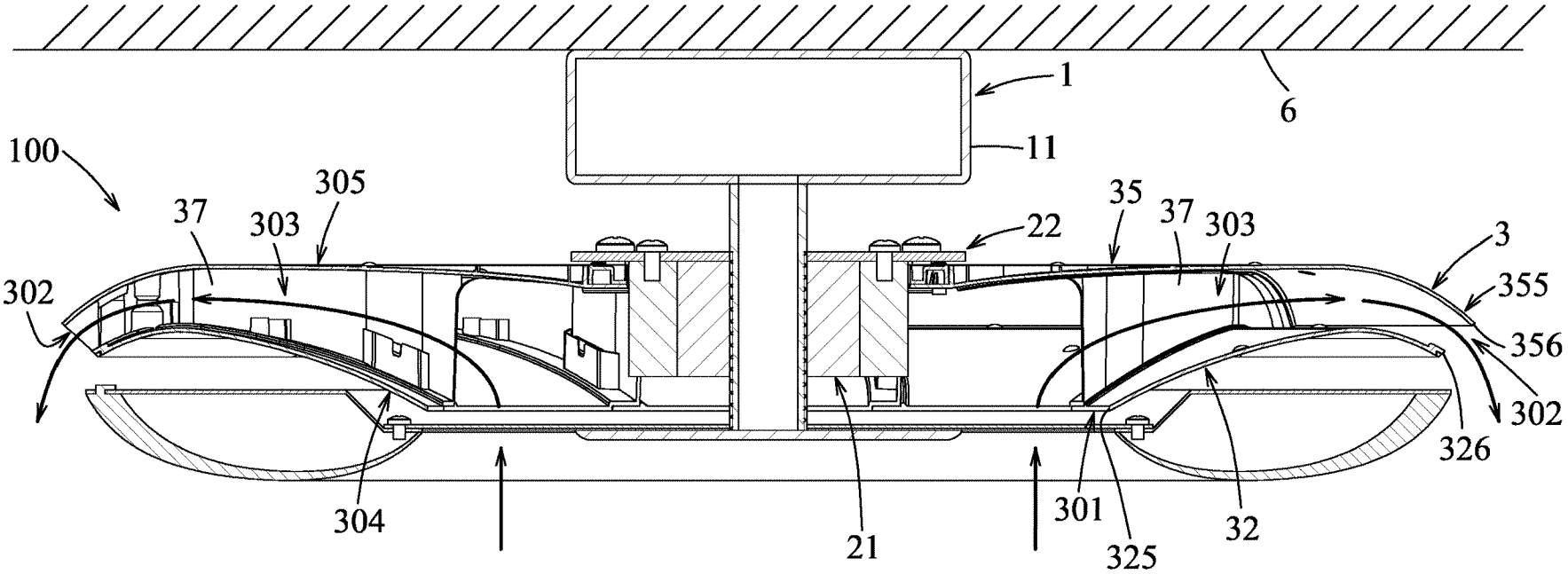
FIG. 13 is a sectional view illustrating the first embodiment being mounted on a ceiling, wherein boldface arrowheads indicate the movement of airflow.

Afterward, as shown in FIGS. 11 to 13, each of the first connecting members 41 of the connecting unit 4 extends through the upper accommodating hole 363 of the upper connecting barrel 359 of a respective one of the blades 31, and threadedly engages the upper threaded post 361 of an adjacent blade 31 that is sleeved by the upper connecting barrel 359 of the respective one of the blades 31, so as to fixedly interconnect the upper blade bodies 35 of each adjacent pair of the blades 31. Each of the second connecting members 42 of the connecting unit 4 extends through the communication hole 358 of a respective one of the blades 31 and the lower accommodating hole 330 of the lower connecting barrel 327 of the adjacent blade 31, and threadedly engages the lower threaded post 336 of another blade 31 adjacent to one side of the adjacent blade 31 opposite to the respective one of the blades 31 (the lower threaded post 336 of the another blade 31 is sleeved by the lower connecting barrel 327 of the adjacent blade 31), so as to fixedly interconnected the lower blade bodies 32 of each adjacent pair of the blades 31 and the upper blade body 35 of a blade 31 that is adjacent to the adjacent pair of the blades 31 (i.e., to fixedly interconnected three successive blades 31). At this time, the lower inner edges 325 of the blades 31 cooperatively define the inlet 301. The upper blade body 35 and the arc-shaped blade body 37 of each of the blades 31 cooperate with the lower blade body 32 and the arc-shaped blade body 37 of the adjacent blade 31 to define an outlet 302 and a guide channel 303. The outer bent guide part 355 of the upper blade body 35 of each of the blades 31 is located above the lower outer edge 326 of the lower blade body 32 of the adjacent blade 31, and the upper outer edge 356 of the outer bent guide part 355 of each of the blades 31 is located radially-outwardly of the lower outer edge 326 of the lower blade body 32 of the adjacent blade 31.

Referring to FIGS. 2, 4 and 13, the transmission plate 22 is disposed on a top surface of the impeller 3 and is co-rotatably connected to the impeller 3 by the second screws 24. Then, the outer threaded section 121 of the fixed tube 12 extends through the through hole 221 of the transmission plate 22, and threadedly engages the threaded hole 213 of the stator 211 of the motor 21 such that a distal portion of the outer threaded section 121 of the fixed tube 12 projects out of a bottom end of the stator 211. Afterward, the rotor 212 of the motor 21 is co-rotatably connected to the transmission plate 22 by the first screws 23.

The connecting frame 51 is threadedly connected to the outer threaded section 121 of the fixed tube 12 through the threaded hole 513 thereof. The lamp plate 52 abuts against a bottom end of the connecting frame 51, and each of the lamp screws 54 extends through a respective one of the through holes 522 of the lamp plate 52 to engage the respective one of the threaded holes 514 of the connecting rods 512, such that the lamp plate 52 is fixedly connected to the connecting rods 512 of the connecting frame 51. The engaging hooks 532 of the lamp cover 53 are respectively inserted into the engaging holes 523 of the lamp plate 52 by moving the lamp cover 53 upwardly relative to the lamp plate 52 such that top portions of the engaging hooks 532 are located above a top surface of the lamp plate 52. Then, the engaging hooks 532 of the lamp cover 53 respectively engage the engaging holes 523 of the lamp plate 52 by rotating the lamp cover 53 relative to the lamp plate 52. Subsequently, the intake cover 55 is threadedly connected to the outer threaded section 121 of the fixed tube 12 via the threaded hole 551 thereof, such that the intake cover 55 is located in the communication hole 533 of the lamp cover 53 and the communication hole 521 of the lamp plate 52. The breaches 515 defined by the connecting frame 51 and the intake holes 552 of the intake cover 55 cooperatively form an intake channel 57 that is in fluid communication with a lower end of the inlet 301.

When the impeller 3 is driven by the motor 21 to rotate, the arc-shaped blade bodies 37 of the blades 31 cooperatively generate radially-outward airflow such that air located under the air circulation device 100 is drawn into the impeller 3 via the intake channel and the inlet 301, and flows radially-outward through the guide channels 303. Since the outer bent guide part 355 of the upper blade body 35 of each of the blades 31 is located above the lower outer edge 326 of the lower blade body 32 of the adjacent blade 31, and since the upper outer edge 356 of the outer bent guide part 355 of each of the blades 31 is located radially-outwardly of the lower outer edge 326 of the lower blade body 32 of the adjacent blade 31, the outer bent guide parts 355 of the blades 31 guide the air to flow radially-outwardly and downwardly to exit the impeller 3 via the outlets 302. The air that flows out of the impeller 3 is mixed with air that is proximate to the air circulation device 100, and the mixed air is then drawn into the air circulation device 100 again, so as to generate air circulations within a space where the air circulation device 100 is disposed.

Since the impeller 3 of the air circulation device 100 according to the disclosure consists of the blades 31 that are separable from each other, packing and transportation of the impeller 3 are relatively easy. Moreover, after the impeller 3 is assembled, the lower blade bodies 32 of the blades 31 cooperatively form a lower cover 304 (see FIG. 13), and the upper blade bodies 35 of the blades 31 cooperatively form an upper cover 305 (see FIG. 13) that cooperates with the lower cover 304 to retain the arc-shaped blade bodies 37 therebetween. As such, additional components (such as a housing or a casing) for enclosing the impeller 3 are not required, and thus the air circulation device 100 has a relatively simple structure.

The add-on unit 5 of this embodiment is exemplarily illustrated as a lamp that is threadedly connected to the outer threaded section 121 of the fixed tube 12 through the threaded hole 513 thereof. In other embodiments, the add-on unit 5 may be an air filter, an air heater or other equipments with different functions.

Figure 9:
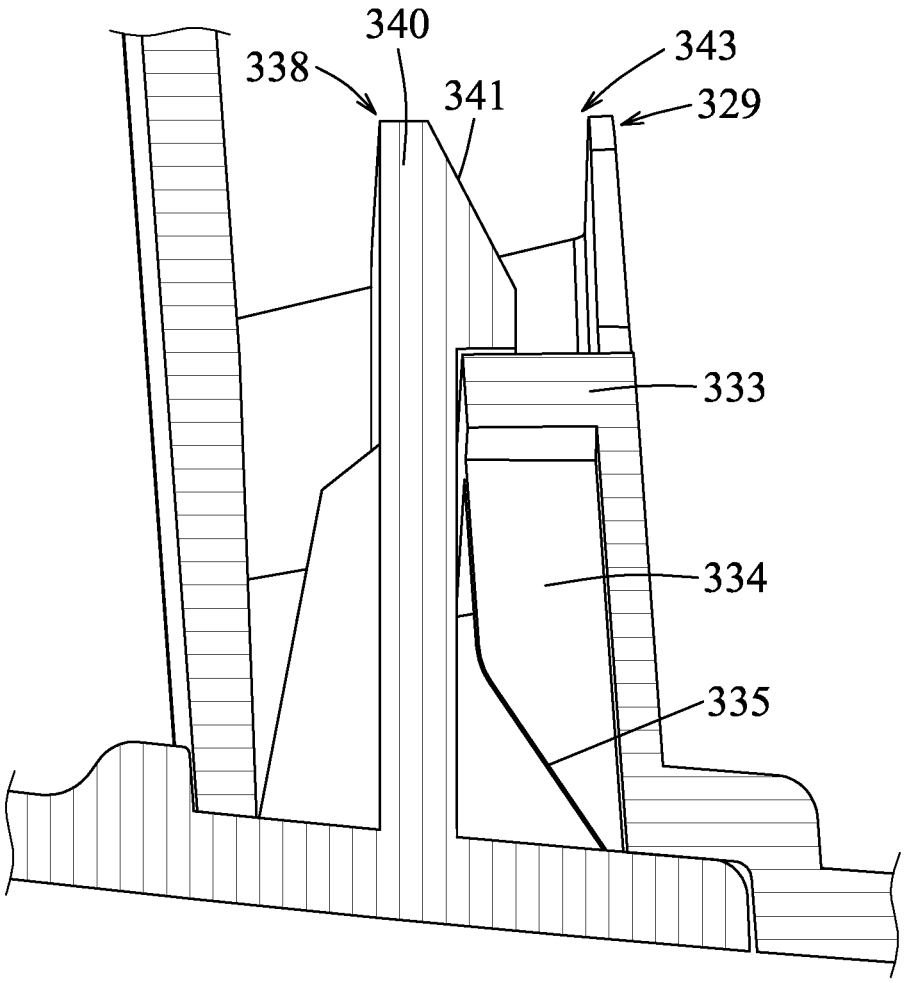
FIG. 9 is another fragmentary sectional view illustrating the projection and the engaging hook.
Figure 10:
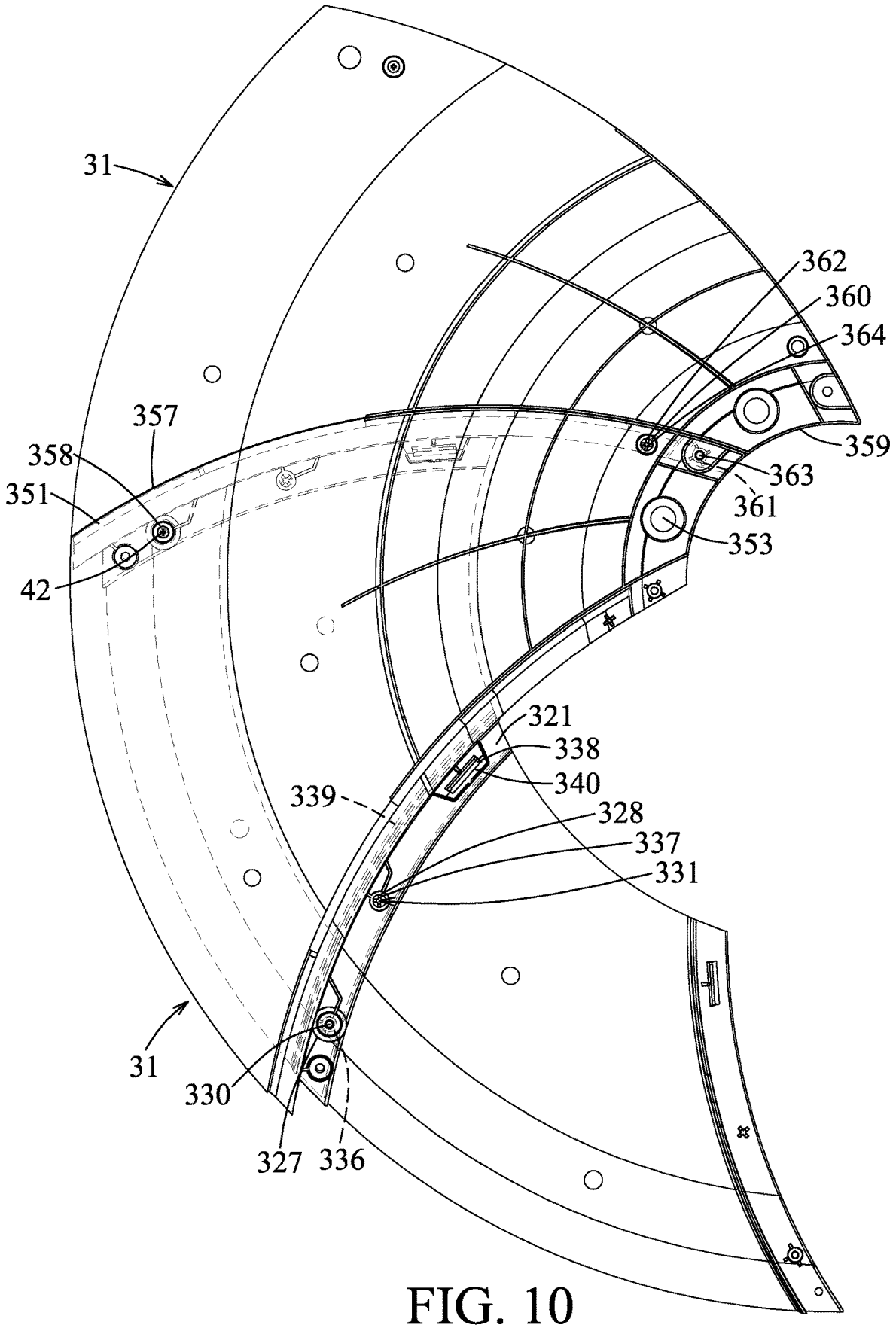
FIG. 10 is a top view illustrating two of the blades being assembled.

Referring to FIGS. 3, 6 and 9, to disassemble the impeller 3, the first and second connecting members 41, 42 need to be separated from the impeller 3 first. Then, the hook portion 340 of the engaging hook 338 of each of the blades 31 is accessible via the inlet 301 and the upper opening 343 of the blade 31, and is able to be pushed or pulled for being separated from the blocking wall 333 of the other adjacent blade 31. As such, the two adjacent blades 31 can be separated from each other. The other blades 31 can be sequentially separated through a manner similar to the above.

Figure 14:
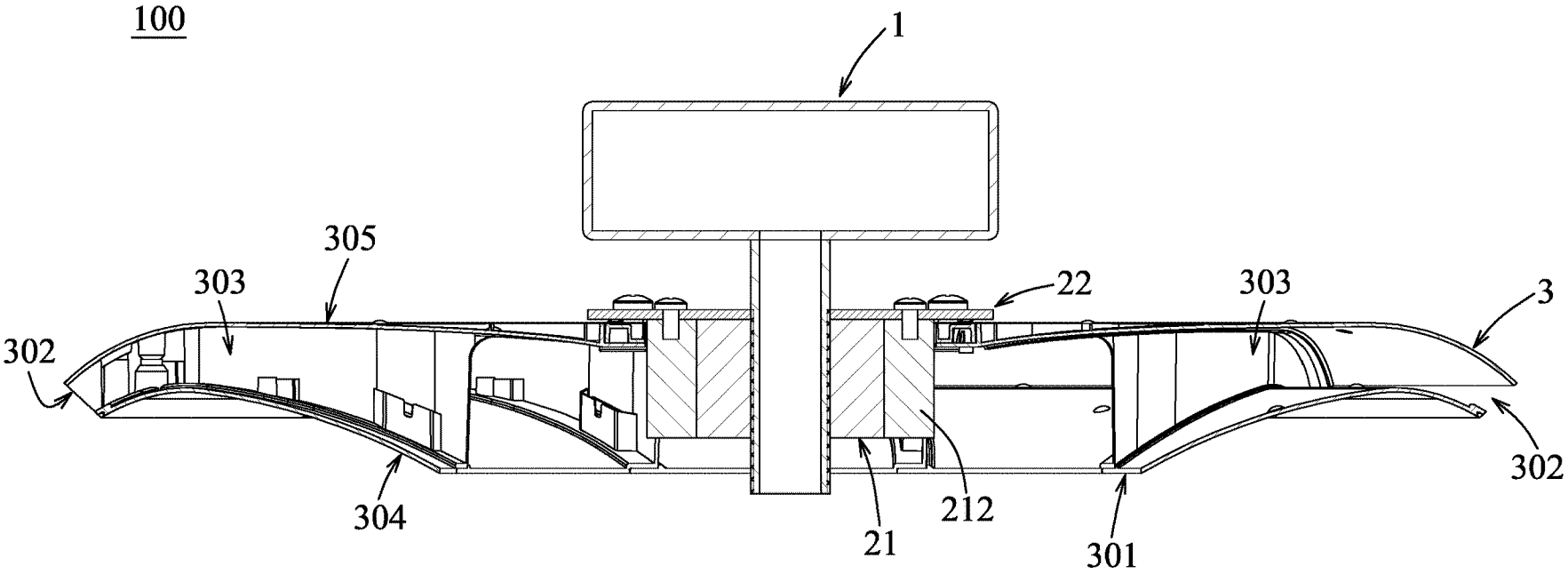
FIG. 14 is a sectional view illustrating a second embodiment of the air circulation device according to the disclosure.

Referring to FIG. 14, the second embodiment of the air circulation device 100 according to the disclosure is similar to the first embodiment, but omits the add-on unit 5 shown in FIG. 4.

In the second embodiment, when the impeller 3 is driven by the motor 21 to rotate, air located under the air circulation device 100 is drawn into the impeller 3 through the inlet 301, flows radially-outward via the guide channels 303, and exits the impeller 3 via the outlets 302.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An air circulation device comprising:

an impeller including a plurality of blades that are disposed about a rotating axis and that are separably interconnected, said blades cooperatively defining an inlet that is located at a central portion of a bottom end of said impeller, a plurality of outlets that are equiangularly disposed about the rotating axis and about said inlet, and a plurality of guide channels each of which is in fluid communication with said inlet and a respective one of said outlets; and a connecting unit fixedly interconnecting each adjacent pair of the blades;

wherein each of said blades has a lower blade body, an upper blade body, and an arc-shaped blade body that is connected between said lower blade body and said upper blade body, two opposite ends of said lower blade body of each of said blades respectively overlapping said lower blade bodies of corresponding adjacent two of said blades that are respectively adjacent to said opposite ends of said lower blade body, two opposite ends of said upper blade body of each of said blades respectively overlapping said upper blade bodies of the corresponding adjacent two of said blades that are respectively adjacent to said opposite ends of said upper blade body, said connecting unit including a plurality of first connecting members, each of said first connecting members fixedly interconnecting said upper blade bodies of a respective adjacent pair of said blades; and wherein said upper blade body of each of said blades has a first upper overlapping section and a second upper overlapping section that are respectively at said opposite ends of said upper blade body, an upper connecting barrel that is disposed on a top surface of said first upper overlapping section, and an upper threaded post that is disposed on a top surface of said second upper overlapping section, said first upper overlapping section of each of said blades being disposed on said top surface of said second upper overlapping section of one of the corresponding adjacent two of said blades, said upper connecting barrel of each of said blades being sleeved on said upper threaded post of the one of the corresponding adjacent two of said blades, each of said first connecting members being configured as a screw, and extending through said upper connecting barrel of a respective one of said blades to threadedly engage said upper threaded post of a corresponding one of said blades.

2. The air circulation device as claimed in claim 1, wherein said lower blade bodies of said blades cooperatively form a lower cover, and said upper blade bodies of said blades cooperatively form an upper cover that cooperates with said lower cover to retain said arc-shaped blade bodies of said blades therebetween.

3. The air circulation device as claimed in claim 1, wherein said upper blade body of each of said blades further has an upper positioning barrel that is disposed on said first upper overlapping section, and an upper positioning post that is disposed on said second upper overlapping section, said upper positioning barrel of each of said blades being sleeved on said upper positioning post of the one of the corresponding adjacent two of said blades.

4. The air circulation device as claimed in claim 1, wherein said upper blade body of each of said blades further has a stopping surface that is connected to a top surface of said second upper overlapping section, said stopping surface of each of said blades being for contacting and limiting said first upper overlapping section of the other one of the corresponding adjacent two of said blades.

5. The air circulation device as claimed in claim 1, further comprising a driving unit that is connected to said impeller to drive rotation of said impeller.

6. The air circulation device as claimed in claim 5, wherein said driving unit includes a motor, and a transmission plate that is driven by said motor to rotate and that is fixedly connected to a top end of said impeller.

7. The air circulation device as claimed in claim 6, further comprising a support, said support including a fixed tube that has an outer threaded section, said transmission plate being formed with a through hole that permits said fixed tube to extend therethrough, said motor being located below said transmission plate, and including a stator, and a rotor that surrounds said stator, said stator being formed with a threaded hole that permits said outer threaded section of said fixed tube to threadedly engage thereto, a top end of said rotor being fixedly connected to said transmission plate.

8. The air circulation device as claimed in claim 7, wherein a distal portion of said outer threaded section of said fixed tube projects out of a bottom end of said stator, said air circulation device further comprising an add-on unit that is located below said impeller and that is threadedly engaged with said outer threaded section of said fixed tube, said add-on unit defining an intake channel that is in fluid communication with a lower end of said inlet.

9. An air circulation device comprising:

an impeller including a plurality of blades that are disposed about a rotating axis and that are separably interconnected, said blades cooperatively defining an inlet that is located at a central portion of a bottom end of said impeller, a plurality of outlets that are equiangularly disposed about the rotating axis and about said inlet, and a plurality of guide channels each of which is in fluid communication with said inlet and a respective one of said outlets; and a connecting unit fixedly interconnecting each adjacent pair of the blades;

wherein each of said blades has a lower blade body, an upper blade body, and an arc-shaped blade body that is connected between said lower blade body and said upper blade body, two opposite ends of said lower blade body of each of said blades respectively overlapping said lower blade bodies of corresponding adjacent two of said blades that are respectively adjacent to said opposite ends of said lower blade body, two opposite ends of said upper blade body of each of said blades respectively overlapping said upper blade bodies of the corresponding adjacent two of said blades that are respectively adjacent to said opposite ends of said upper blade body, said connecting unit including a plurality of first connecting members, each of said first connecting members fixedly interconnecting said upper blade bodies of a respective adjacent pair of said blades; and wherein said lower blade body of each of said blades has a first lower overlapping section and a second lower overlapping section that are respectively at said opposite ends of said lower blade body, said first lower overlapping section of each of said blades being disposed on a top surface of said second lower overlapping section of one of the corresponding adjacent two of said blades, said upper blade body of each of said blades having a first upper overlapping section and a second upper overlapping section that are respectively at said opposite ends of said upper blade body, said second upper overlapping section of each of said blades being located above said first lower overlapping section of said blade, said first upper overlapping section of each of said blades being located at one side of said arc-shaped blade body of said blade opposite to said second lower overlapping section of said blade, said first upper overlapping section of each of said blades being disposed on a top surface of said second upper overlapping section of the one of the corresponding adjacent two of said blades, said connecting unit further including a plurality of second connecting members, each of said second connecting members fixedly interconnecting said lower blade bodies of a respective adjacent pair of said blades and said upper blade body of one of said blades that is adjacent to the respective adjacent pair of said blades.

10. The air circulation device as claimed in claim 9, wherein said lower blade body of each of said blades further has a lower connecting barrel that is disposed on a top surface of said first lower overlapping section, and a lower threaded post that is disposed on said top surface of said second lower overlapping section, said lower connecting barrel of each of said blades being sleeved on said lower threaded post of the one of the corresponding adjacent two of said blades, each of said second connecting members being configured as a screw, and extending through said upper blade body of a respective one of said blades and through said lower connecting barrel of an adjacent one of said blades to threadedly engage said lower threaded post of a corresponding one of said blades.

11. The air circulation device as claimed in claim 9, wherein said lower blade body of each of said blades further has an lower positioning barrel that is disposed on a top surface of said first lower overlapping section, and an lower positioning post that is disposed on said top surface of said second lower overlapping section, said lower positioning barrel of each of said blades being sleeved on said lower positioning post of the one of the corresponding adjacent two of said blades.

12. The air circulation device as claimed in claim 9, wherein said lower blade body of each of said blades further has a projection that is disposed on a top surface of said first lower overlapping section, and an engaging hook that is disposed on said top surface of said second lower overlapping section, said projection of each of said blades being engaged with said engaging hook of the one of the corresponding adjacent two of said blades.

13. The air circulation device as claimed in claim 12, wherein said projection of each of said blades has a surrounding wall that is connected to said arc-shaped blade body, and a blocking wall that is connected to said surrounding wall and that is spaced apart from said arc-shaped blade body, said arc-shaped blade body of each of said blades cooperating with said surrounding wall to define a lower opening that permits said engaging hook of the one of the corresponding adjacent two of said blades to extend therethrough to engage said blocking wall of said blade.

14. The air circulation device as claimed in claim 13, wherein said engaging hook of each of said blades has an upper inclined surface, said projection of each of said blades further having a guiding wall that is connected to said surrounding wall and a bottom side of said blocking wall and that has a lower inclined surface, said lower inclined surface of each of said blades being for slidably contacting said upper inclined surface of said engaging hook of the one of the corresponding adjacent two of said blades so as to deform said engaging hook.

15. The air circulation device as claimed in claim 13, wherein said arc-shaped blade body of each of said blades cooperating with said surrounding wall to further define an upper opening that is located above said lower opening.

16. The air circulation device as claimed in claim 9, wherein said lower blade body of each of said blades further has a stopping rib that is connected to said top surface of said second lower overlapping section for contacting and limiting said first lower overlapping section of said lower blade body of the other one of the corresponding adjacent two of said blades.

17. The air circulation device as claimed in claim 9, wherein said lower blade body of each of said blades further has a lower outer edge, said upper blade body of each of said blades further having an outer bent guide part that extends radially-outwardly and bends downwardly, and that has an upper outer edge, said outer bent guide part of said upper blade body of each of said blades being located above said lower outer edge of said lower blade body of the one of the corresponding adjacent two of said blades, said upper outer edge of said outer bent guide part of each of said blades being located radially-outwardly of said lower outer edge of said lower blade body of the one of the corresponding adjacent two of said blades.

* * * * *